US007735658B2

(12) United States Patent
Hidaka et al.

(10) Patent No.: US 7,735,658 B2
(45) Date of Patent: Jun. 15, 2010

(54) CLASSIFICATION APPARATUS FOR POWDERY SUBSTANCE

(75) Inventors: Jusuke Hidaka, Kyoto (JP); Shinzo Yoshikado, Kyoto (JP); Yoshiyuki Shirakawa, Kyoto (JP); Yoshiaki Ito, Kyoto (JP); Kiyoshi Hayakawa, Shiga (JP); Yuuko Watanabe, Kyoto (JP)

(73) Assignees: The Doshisha, Kyoto (JP); Kyoto University, Kyoto (JP); Fukujuen Co., Ltd., Kyoto (JP)

( * ) Notice: Subject to any disclaimer, the term of this patent is extended or adjusted under 35 U.S.C. 154(b) by 85 days.

(21) Appl. No.: 12/161,906

(22) PCT Filed: Jan. 23, 2007

(86) PCT No.: PCT/JP2007/050999

§ 371 (c)(1),
(2), (4) Date: Nov. 18, 2008

(87) PCT Pub. No.: WO2007/083813

PCT Pub. Date: Jul. 26, 2007

(65) Prior Publication Data

US 2009/0078619 A1 Mar. 26, 2009

(30) Foreign Application Priority Data

Jan. 23, 2006 (JP) ..... 2006-013638

(51) Int. Cl.
*B04C 5/12* (2006.01)

(52) U.S. Cl. ..... 209/721; 209/659; 209/715; 209/142

(58) Field of Classification Search ..... 209/142, 209/621, 721, 478, 715
See application file for complete search history.

(56) References Cited

U.S. PATENT DOCUMENTS

| | | | | |
|---|---|---|---|---|
| 2,498,832 | A * | 2/1950 | Watson et al. | 209/712 |
| 3,720,313 | A * | 3/1973 | Lapple | 209/133 |
| 6,276,534 | B1 * | 8/2001 | Huang et al. | 209/139.2 |
| 7,424,956 | B2 * | 9/2008 | Kohno | 209/721 |
| 7,506,765 | B2 * | 3/2009 | Franzreb et al. | 209/232 |
| 2006/0214036 | A1 * | 9/2006 | Makino | 241/5 |

FOREIGN PATENT DOCUMENTS

JP S63-84676 A 4/1988

(Continued)

*Primary Examiner*—Gene Crawford
*Assistant Examiner*—Terrell H Matthews
(74) *Attorney, Agent, or Firm*—Hodgson Russ LLP

(57) ABSTRACT

A classification apparatus including a magnetic stirrer composed of main body (1) and rotor (2) and, arranged on the main body of the magnetic stirrer, classification tube (3). The interior of the classification tube is provided with classification compartments (A-E) partitioned from each other by divider plates (5*a*-5*b*). The lowermost classification compartment (A) is furnished with gas emission conduit (7). In the classification compartment (A), the rotor (2) of the magnetic stirrer is arranged. From gas supply source (8), a high-pressure gas is fed into the gas emission conduit. By means of the gas emitted from the gas emission conduit, a vortex flow rising from the lowermost classification compartment sequentially toward higher classification compartments is generated in the classification tube. Simultaneously, the rotor of the magnetic stirrer is rotated, so that powdery substance (O) within the classification compartment (A), while being conveyed by the vortex flow, undergoes particle size classification in each of the classification compartments.

18 Claims, 10 Drawing Sheets

FOREIGN PATENT DOCUMENTS

| | | | |
|---|---|---|---|
| JP | 05-285411 | A | 11/1993 |
| JP | 11-184153 | A | 7/1999 |
| JP | 2000-042492 | A | 2/2000 |
| JP | 2002-035699 | A | 2/2002 |

* cited by examiner

A

B

A

B

A

10 μm

B

50 μm

CLASSIFICATION APPARATUS FOR POWDERY SUBSTANCE

CROSS-REFERENCE TO RELATED APPLICATIONS

This application claims the benefit of priority to International Patent Application PCT/JP2007/050999 filed on Jan. 23, 2007, which claims priority to Japan patent application number 2006013638 filed on Jan. 23, 2006, and via that PCT patent application also claims the benefit of priority to Japan patent application number 2006013638.

TECHNICAL FIELD

The present invention relates to a dry classification apparatus for classifying powdery substances selected from a group consisting of, for example, powdered green tea such as Matcha, powdered health food and powdered Chinese herbal medicine according to the size.

BACKGROUND ART

Powdered green tea, especially Matcha is effective in maintaining beauty and health because it enables ingestion of not only water soluble substances but also all insoluble components (lipid soluble vitamin, mineral, etc.), that is, abundant function components such as various vitamins, catechin (tannin), caffeine, amino acid, dietary fiber, and micro-mineral, and also has low calorie. Thus, owing to rising concern about beauty and health in recent years, drinking Matcha creates a boom.

Conventionally, consumers drink Matcha by putting an appropriate amount of Matcha in a tea cup, pouring hot water therein, quickly mixing Matcha in the hot water using a tea stirrer. In this case, consumers can more easily drink Matcha if it is easily dissolved in hot water or cold water without using the tea stirrer. In addition, it is assumed that if the dispersibility of Matcha is enhanced, the absorptance of ingredients of Matcha into the body is accelerated so that physiological activity of the body is enhanced.

However, when consumers try to dissolve Matcha in hot water or cold water without using the tea stirrer, they cannot dissolve it completely, and lumps of Matcha not dissolved may float in the water. The Matcha not completely dissolved in the water is not pleasant to the taste and tastes gritty when consumers drink it.

In recent years, many consumers take in health food and Chinese herbal medicine in order to maintain beauty and health. Consumers drink some powdered health food and powdered Chinese herbal medicine by dissolving them in cold water. In this case, just like Matcha, the powder is not completely dissolved and lumps of the powder not dissolved float in the water, and the powder not completely dissolved in the water is not pleasant to the taste when consumers drink it. Thus it becomes difficult to drink the powdered health food and the powdered Chinese herbal medicine.

In this case, the particle size of Matcha, the powdered health food and the powdered Chinese herbal medicine is not uniform, and according to fine analysis, it is found that each of those powdery substances is a mixture of fine grained particles (for example, average particle diameter is smaller than or equal to 10 μm) and slightly large particles (for example, average particle diameter is 10 to 60 μm). The fine grained particles have advantages in that the absorptance to the body is satisfactory, the precipitation after being dispersed in water is suppressed, and they can be easily re-dispersed even if precipitation occurs, and they taste pleasant and are soft and pleasant on the tongue, whereas the large particles have advantages in that the wetness is satisfactory and the dispersibility is satisfactory.

Thus, if an appropriate dry classification apparatus for classifying powdery substances according to the size is provided, by employing the classification apparatus and performing classification, it is possible to produce a mixture made from only particles of a size within a constant range or a mixture including particles of different sizes by a constant fraction, whereby it is possible to produce the poedery substance which easily disperses into cold water without forming a lump, the powdery substance which rarely precipitates once dispersed, and the powdery substance which is soft and pleasant to the taste and on the tongue during drinking.

In the prior art, there exists a method of classifying the powdery substances according to the size by sieving, but a dry classification apparatus for easily and efficiently classifying the powdery substance according to the size does not exist.

DISCLOSURE OF THE INVENTION

Problems to be Solved by the Invention

Therefore, an object of the present invention is to provide a dry classification apparatus capable of easily and accurately classifying powdered green tea such as Matcha, powdered health food and powdered Chinese medicine according to the size.

Means for Solving the Problems

In order to solve the above problems, the present invention provides a classification apparatus for a powdery substance comprising a classification tube provided with an upper end opening, a closed lower end, a filter attached to the upper end opening, and at least two classification compartments divided by divider plates and lined up and down in the interior space thereof, each of the divider plates having at least one opening, the first classification compartment having a supply port for a powdery substance to be classified, a gas emission conduit extending from the outside into the first compartment through a peripheral wall, a distal end opening of the gas emission conduit being directed in a tangential direction of an inner peripheral surface at the vicinity of a bottom surface of the classification compartment, high pressure gas being supplied to the gas emission conduit from a gas supply source arranged outside the classification tube, a vortex flow being generated in the classification tube by the gas from the gas emission conduit and rising from the first classification compartment sequentially towards the higher classification compartments; and conveyance acceleration means for accelerating conveyance of the powdery substance by the vortex flow so as to prevent the powdery substance from remaining in the first classification compartment while the vortex flow is being generated, whereby the powdery substance of the first classification compartment is classified in every classification compartment according to the size while being conveyed by the vortex flow.

According to a preferred embodiment of the present invention, the conveyance acceleration means includes a magnetic stirrer composed of a main body and a rotor, and the classification tube is arranged upright on the main body of the magnetic stirrer, and the rotor of the magnetic stirrer is arranged in the first classification compartment, and the rotor of the magnetic stirrer is rotated simultaneously with the generation of the vortex flow.

According to another preferred embodiment of the present invention, the conveyance acceleration means includes four to eight synthetic resin balls arranged in the first classification compartment, and the inner diameter of the first classification compartment is 2.6 to 4 times as large as the diameter of each of the balls, whereby the balls are rotated in an integrated manner in the first classification compartment by the gas from the gas emission conduit and the vortex flow rises from a gap in the center of the aggregate of the balls.

According to further preferred embodiment of the present invention, a height between the bottom surface of the classification tube and the first divider plate is set to be a level at which, when the vortex flow is generated, particles of the powdery substance suddenly blown up by the vortex flow once return to the first classification compartment without reaching a second classification compartment.

According to further preferred embodiment of the present invention, the classification tube includes at least three classification compartment, and a reverse circular cone shaped passage is arranged in the second classification compartment for communicating the first classification compartment with the third classification compartment, and a lower end of the passage is connected to a circular opening formed at the middle of the first divider plate, and an upper end is connected to a circular region including an opening of the second divider plate, and when the vortex flow is generated, particles of the powdery substance suddenly blown up by the vortex flow once return to the first classification compartment through the passage without reaching the third classification compartment.

According to further preferred embodiment of the present invention, a needle for applying positive or negative charge to the particles conveyed by the vortex flow protrudes in the first classification compartment, and the needle is connected to a high voltage power source arranged outside the classification tube through a cable.

According to further preferred embodiment of the present invention, the filter is charged oppositely to the charge applied to the particles by the needle.

In order to solve the above problem, the present invention also provides a classification apparatus for a powdery substance comprising a container with an upper end opening, a powdery substance to be classified being introduced in the container; a classification tube connected to the upper end opening of the container, the classification tube comprising a filter attached to an upper end opening thereof, a plurality of classification compartments divided by divider plates and lined up and down in the interior space thereof, each of the divider plates having at least one opening, a lower end of the classification tube being provided with a connecting part, the connecting part having an inner flange and a means for connecting to the container, the inner flange extending inward over an inner peripheral surface of the container, the connecting part having a plurality of gas emission conduits extending from the outside into the container, the gas emission conduits being arranged at intervals in a peripheral direction of the connecting part, distal end openings of the gas emission conduits being inclined at a constant angle downward and along the peripheral wall towards a bottom surface of the container, high pressure gas being supplied to the gas emission conduits from a gas supply source arranged outside the classification tube, a vortex flow being generated by the gas from the gas emission conduits and rising from the interior of the container sequentially towards the higher classification compartments in the classification tube; and conveyance acceleration means for accelerating conveyance of the powdery substance by the vortex flow so as to prevent the powdery substance from remaining in the container while the vortex flow is being generated, whereby the powdery substance of the container is classified in every classification compartment according to the size while being conveyed by the vortex flow.

According to a preferred embodiment of the present invention, the conveyance acceleration means includes a magnetic stirrer composed of a main body and a rotor, and the container is arranged upright on the main body of the magnetic stirrer, and the rotor of the magnetic stirrer is arranged in the container, and the rotor of the magnetic stirrer is rotated simultaneously with the generation of the vortex flow.

According to another preferred embodiment of the present invention, the conveyance acceleration means includes four to eight synthetic resin balls arranged in the container, and the inner diameter of the container is 2.6 to 4 times as large as the diameter of each of the balls, and the balls is rotated in an integrated manner in the container by the gas from the gas emission conduit, and the vortex flow rises from a gap in the center of the aggregate of the balls.

According to further preferred embodiment of the present invention, a reverse circular cone shaped passage is arranged in a space between an inner flange of the classification tube and the first divider plate for communicating the container with the first classification compartment, and a lower end of the passage is connected to a circular opening of the inner side of the inner flange, and an upper end is connected to a circular region including an opening of the first divider plate, and when the vortex flow is generated, particles of the powdery substance suddenly blown up by the vortex flow once return to the container through the passage without reaching the first classification compartment.

According to further preferred embodiment of the present invention, the peripheral wall of the container is provided with a through-hole with a sealing plug, and a needle is inserted in and fixed to the through-hole, the needle extending from the outside of the container into the container, and the needle is connected to a high voltage power source through a cable, and the particles conveyed by the vortex flow are charged negatively or positively in contact with the needle.

According to further preferred embodiment of the present invention, the filter is charged oppositely to the charge applied to the particles.

According to further preferred embodiment of the present invention, the classification tube is separable for every classification compartment.

According to further preferred embodiment of the present invention, the rotor of the magnetic stirrer is in the form of a rod having a rounded triangular cross section.

According to further preferred embodiment of the present invention, the ball has a double-layer structure consisting of a spherical core of a first synthetic resin, and an outer layer of a second synthetic resin overlaying the core.

According to further preferred embodiment of the present invention, each of the balls includes a spherical metal core or a cavity.

According to further preferred embodiment of the present invention, the synthetic resin is a polymer selected from a group consisting of one of polyacetal, Teflon (registered trademark), nylon, polyethylene, polypropylene, polycarbonate, polyphenylene sulfide, polymethyl pentene, polyethersulfone, and polyethylene telephtalate; mixture of the polymers; or a copolymer containing a constituting monomer of the polymers.

Effects of the Invention

According to the present invention, high pressure gas is supplied into the classification tube provided with a plurality of classification compartments, a vortex flow is generated in the classification tube and rising from the lowermost classification compartment towards the higher classification compartment, and at the same time, the conveyance acceleration means is arranged in the lowermost classification compartment for accelerating conveyance of powdery substance by the vortex flow and preventing the powdery substance from remaining in the container, so that the powdery substance can be easily and efficiently classified in every classification compartment according to the size in such a manner that the particle size becomes gradually smaller with increment of level of the classification compartment.

Furthermore, according to the present invention, the powdery substance manufactured in preprocess and contained in the container can be easily classified according to the size by connecting the classification tube to the container.

DESCRIPTION OF REFERENCE NUMERALS

Figure 1:
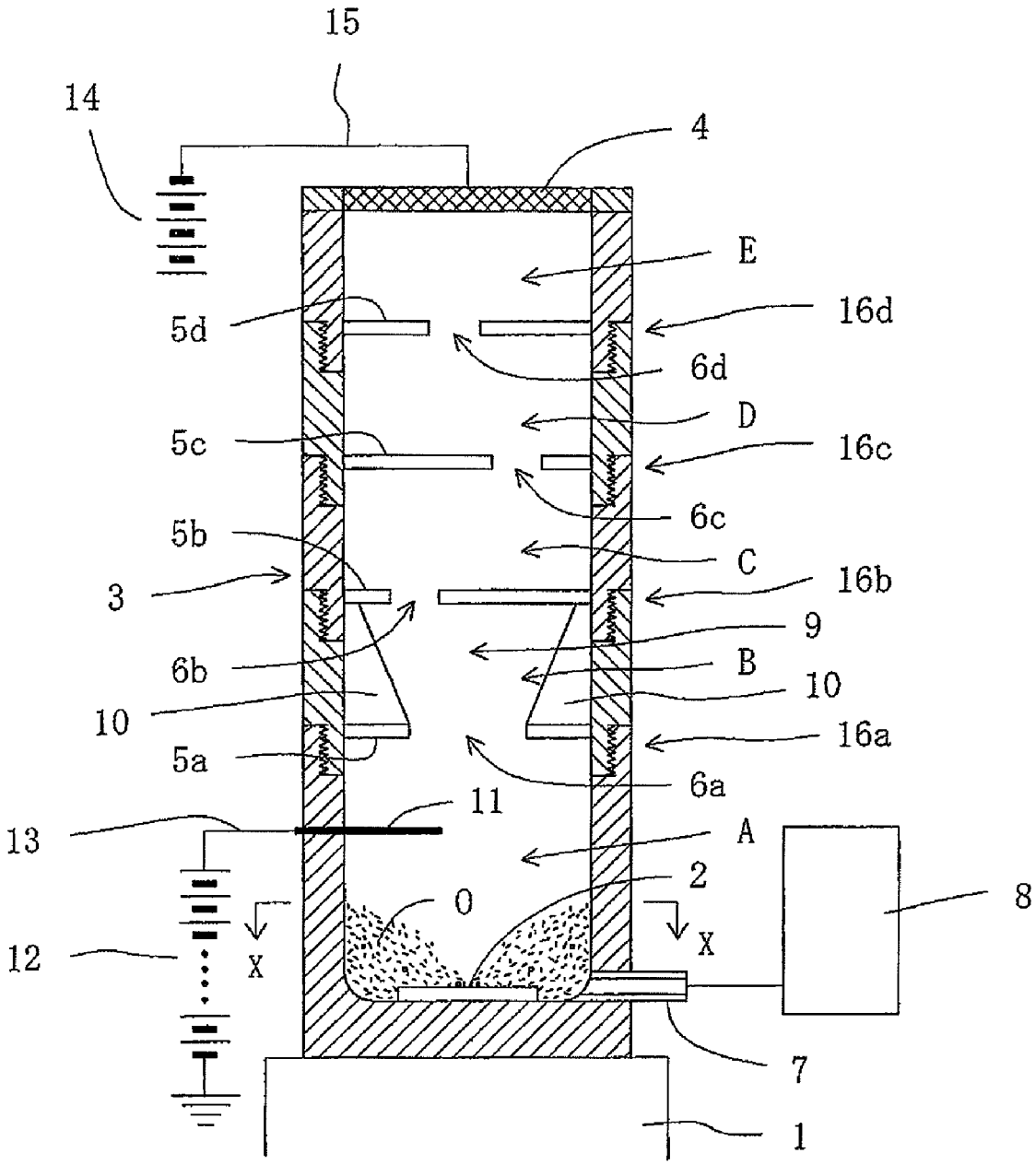
FIG. 1 is a longitudinal cross sectional view showing a schematic configuration of a classification apparatus for a powdery substance according to an embodiment of the present invention.

1 Main body of magnetic stirrer
2 Rotor of magnetic stirrer
3 Classification tube
4 Filter
5*a* to 5*d* Divider plate
6*a* to 6*d* Opening
7 Gas emission conduit
8 Gas supply source
9 Passage (through-hole)
10 Columnar member
11 Needle
12 High voltage power source
13 Cable
14 Second power source
15 Cable
16*a* to 16*d* Joint portion
A to E Classification compartment
O Powdery substance

BEST MODE FOR CARRYING OUT THE INVENTION

Preferred embodiments of the present invention will be described below with reference to the accompanied drawings. FIG. 1 is a longitudinal cross sectional view showing a schematic configuration of a classification apparatus of powdery substance according to an embodiment of the present invention, FIG. 2(A) is a cross sectional view taken along line X-X of FIG. 1, FIG. 2(B) is a perspective view of a rotor of a magnetic stirrer of the classification apparatus of FIG. 1, and FIG. 3 is a schematic perspective view of the classification apparatus of FIG. 1 with a vortex flow therein.

Figure 2:
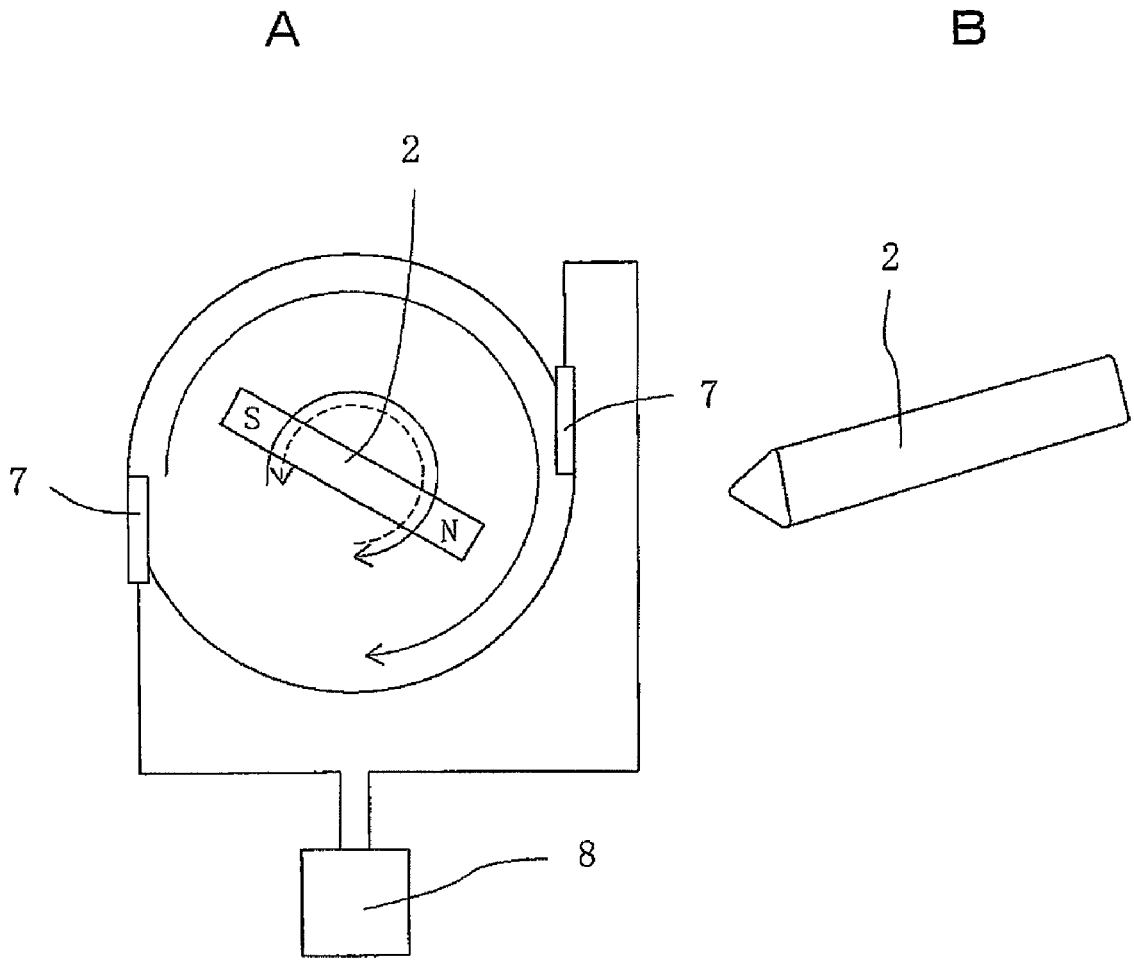
FIG. 2(A) is a cross sectional view taken along line X-X of FIG. 1.
FIG. 2(B) is a perspective view of a rotor of a magnetic stirrer of the classification apparatus of FIG. 1.
Figure 3:
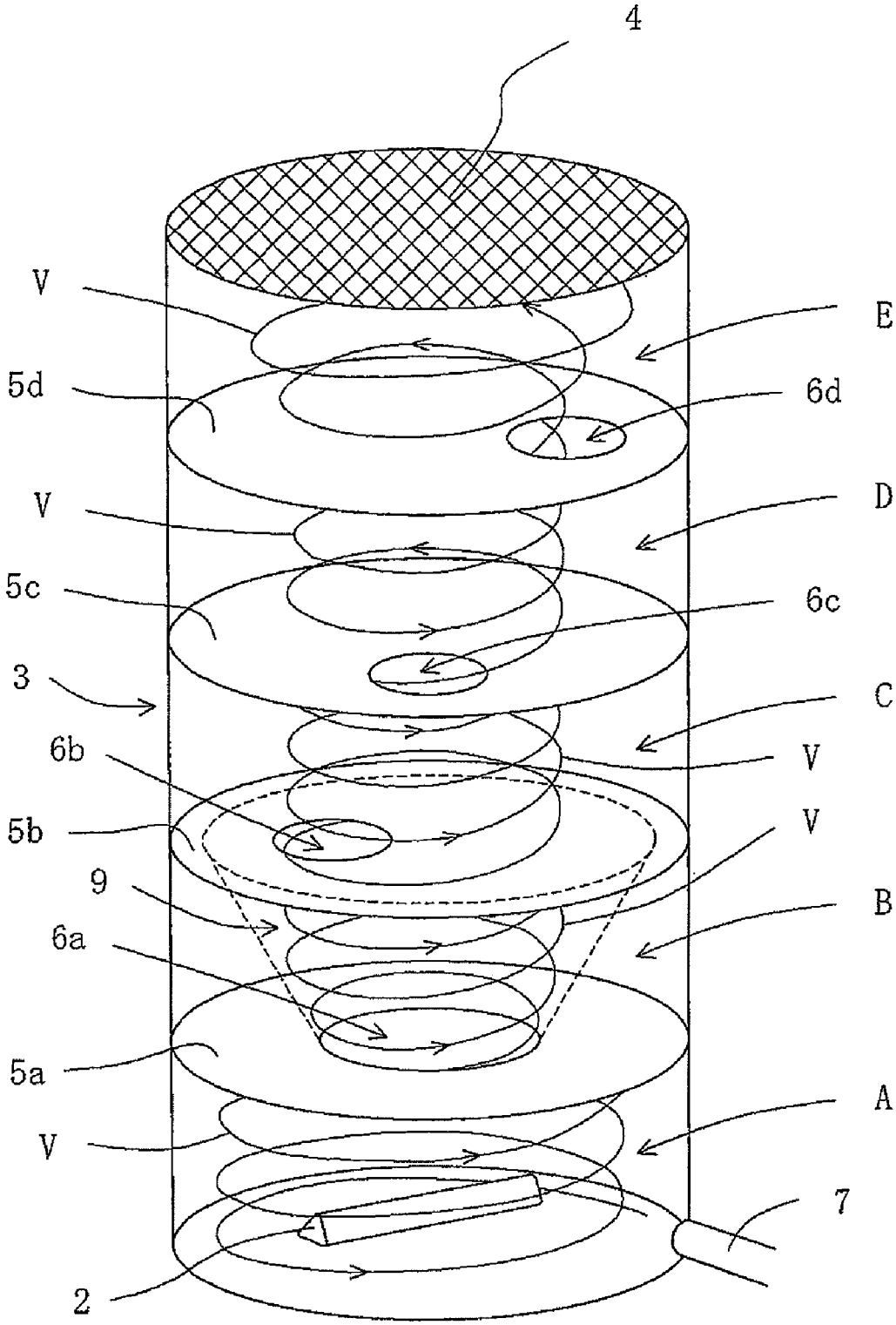
FIG. 3 is a schematic perspective view of the classification apparatus of FIG. 1 with a vortex flow therein.

Referring to FIGS. 1 to 3, a classification tube 3 is arranged in the classification apparatus of the present invention. The classification tube 3 has an upper end opening, a closed lower end and a filter 4 attached to the upper end opening. Japanese paper, membrane filter, and the like can be used for the filter 4.

The interior space of the classification tube 3 is partitioned by divider plates 5*a* to 5*d* into five classification compartments A to E lined up and down. Each of the divider plates 5*a* to 5*d* has openings 6*a* to 6*d*. The number of classification compartments is not limited to the embodiment, and at least two or more classification compartments merely need to be provided. A boundary region of the bottom surface (inner bottom surface of the classification tube 3) and the inner peripheral surface of the first classification compartment A is rounded.

In the peripheral wall of the classification tube 3, joint portions 16*a* to 16*d* are provided on the downside of the divider plates 5*a* to 5*d*. At each joint portion 16*a* to 16*d*, the inside of the lower peripheral wall portion is cutout into a cylindrical shape by half thickness, and the outside of the upper peripheral wall portion is cutout into a cylindrical shape by half thickness. A screw groove is formed on the inner peripheral surface of the cutout part of the lower peripheral wall portion, while a counter screw groove is formed on the outer peripheral surface of the cutout part of the upper side peripheral portion. The classification tube 3 thus can be separated into two portions for every classification compartment A to E.

The powdery substance O to be classified is supplied into the first classification compartment A from the upper end opening which is provided by separating the first classification compartment A in the up and down direction at the joint portion 16*a*.

Two gas emission conduits 7 extend from the outside into the first classification compartment A through the peripheral wall. The gas emission conduit 7 is arranged facing the diameter direction of the transverse surface of the classification compartment, and the distal end opening of the gas emission conduit 7 is directed in the tangent direction of the inner peripheral surface at the vicinity of the bottom surface of the classification compartment A so that the emitted gas flow flows in the same direction around the center axis of the classification compartment A (see FIG. 2(A)). The number of gas emission conduits 7 is not limited to the embodiment, and at least one gas emission conduit 7 merely needs to be provided.

High pressure gas is supplied into the gas emission conduit 7 from a gas supply source 8 such as an air pump or an air compressor arranged outside the classification tube 3, thereby a vortex flow V is generated in the classification tube 3 by the gas emitted from the gas emission conduit 7 and rises from the first classification compartment A toward higher classification compartments.

A columnar member 10 with the same dimension as the classification compartment B is arranged in the second classification compartment B. A reverse circular cone shaped passage 9 is arranged at the middle of the columnar member 10. The lower end of the passage 9 is connected to the circular opening 6*a* formed at the middle of the first divider plate 5*a*, and the upper end is connected to a circular region including the opening 6*b* of the second divider plate 5*b*. The passage 9 communicates the first classification compartment A with the third classification compartment C. According to the passage 9, when the vortex flow V is generated, the particles of the powdery substance suddenly blown up by the vortex flow V once return to the classification compartment A through the passage 9 without reaching the classification compartment C. The inclination angle of the inner peripheral surface of the passage 9 merely needs to be greater than or equal to 45°, and is preferably 60°.

The passage 9 is arranged in the second classification compartment B in this embodiment, as described above, but the passage 9 may be arranged in view of the operating conditions such as the type of powdery substance to be classified and the characteristics of the generated vortex flow V, if necessary.

When the passage 9 is not arranged, the height between the bottom surface of the classification tube 3 and the first divider plate 5*a* is preferably set to be a level at which, when the vortex flow V is generated, the particles of the powder substance O suddenly blown up by the vortex flow V once return to the first classification compartment A without reaching the second classification compartment B.

The classification apparatus of the present invention includes conveyance acceleration means for accelerating conveyance of the powdery substance O by the vortex flow V so as to prevent the powdery substance O from remaining in the first classification compartment A while the vortex flow V is being generated. In this embodiment, the conveyance acceleration means includes a magnetic stirrer composed of a main body 1 and a rotor 2. The classification tube 3 is arranged upright on the main body 1 of the magnetic stirrer, and the rotor 2 of the magnetic stirrer is arranged in the first classification compartment A. As shown in FIG. 2(B), the rotor 2 is in the form of a rod having a triangular cross section with rounded corners, and the entire surface of the rotor 2 is covered with plastic resin. While the rotor 2 is rotated, the rotor 2 forces the powdery substance O which is collected at the central part of the classification compartment by the vortex flow to move towards the inner peripheral surface so as to be easily conveyed on the vortex flow. Since the rotor 2 has a triangular cross section, the inclined surfaces of the rotor 2 enhance the above-mentioned action of the rotating rotor 2.

A needle 11 for applying positive charge to the particles of the powdery substance O conveyed by the vortex flow V protrudes in the first classification compartment A in such a manner that the needle 11 does not block the rotation of the rotor 2. The needle 11 is connected to a high voltage power source 12 arranged outside the classification apparatus through a cable 13. The particles electrically repel against each other if the particles of the powdery substance are applied to the same charge, so that the dispersibility of the particles conveyed by the vortex flow V further increases, which leads to the enhancement of the precision and efficiency of classification.

The filter 4 arranged at the upper end opening of the classification tube 3 is connected to a second power source 14 arranged outside the classification apparatus through a cable 15, and the filter 4 is charged (negative charge) oppositely to the charge applied to the particles of the powdery substance by the needle 11. The particles charged with positive charge are electrically attracted to the filter 4 charged with negative charge, thereby assisting the dynamical conveying action of the vortex flow V.

The high pressure gas is supplied from the gas supply source 8 to the gas emission conduit 7, and emitted from the gas emission conduit 7. The gas flow generastes a vortex flow V rising from the first classification compartment A, passes through the openings 6*a* to 6*d* of each divider plate 5*a* to 5*d*, and finally passes through the filter 4 to be emitted to the outside. At the same time, the rotor 2 of the magnetic stirrer is rotated. In this case, the direction of the rotation of the rotor 2 may be is the same as that of the vortex flow or may be different from the direction of the vortex flow.

The powdery substance O supplied to the classification compartment A is moved towards the inner peripheral surface of the classification compartment A by the rotating rotor 2, and rises certainly while being conveyed by the vortex flow V. Here, the particles of the powdery substance O are charged with positive charge in contact with the needle 11 and repel against each other so that the dispersibility of the particles is enhanced. The particles of the powdery substance O rise while being conveyed by the vortex flow V and are deposited in the corresponding classification compartments A to E according to the size, and the particles of the powdery substance passed through the uppermost classification compartment E are captured by the filter 4. The particles of the powdery substance are collected in each classification compartment A to E according to the size in such a manner that the particle size becomes gradually smaller with increment of level of the classification compartment.

In this case, the flow rate of the gas flow emitted from the gas emission conduit 7 and the rotation speed of the rotor 2 rarely influence the efficiency of classification, and therefore, the flow rate of the gas flow and the rotation speed of the rotor 2 are set in such a manner that a stationary vortex flow arises and that a powdery substance does not remain at the bottom of the first classification compartment A.

In this embodiment, the powdery substance O to be classified is supplied into the first classification compartment A of the classification tube 3 in every classifying operation, but a supply port for the powdery substance may be formed at the peripheral wall portion of the first classification compartment A, whereby the powdery substance is continuously supplied into the first classification compartment A from such supply port so as to continuously perform the particle size classification.

Figure 9:
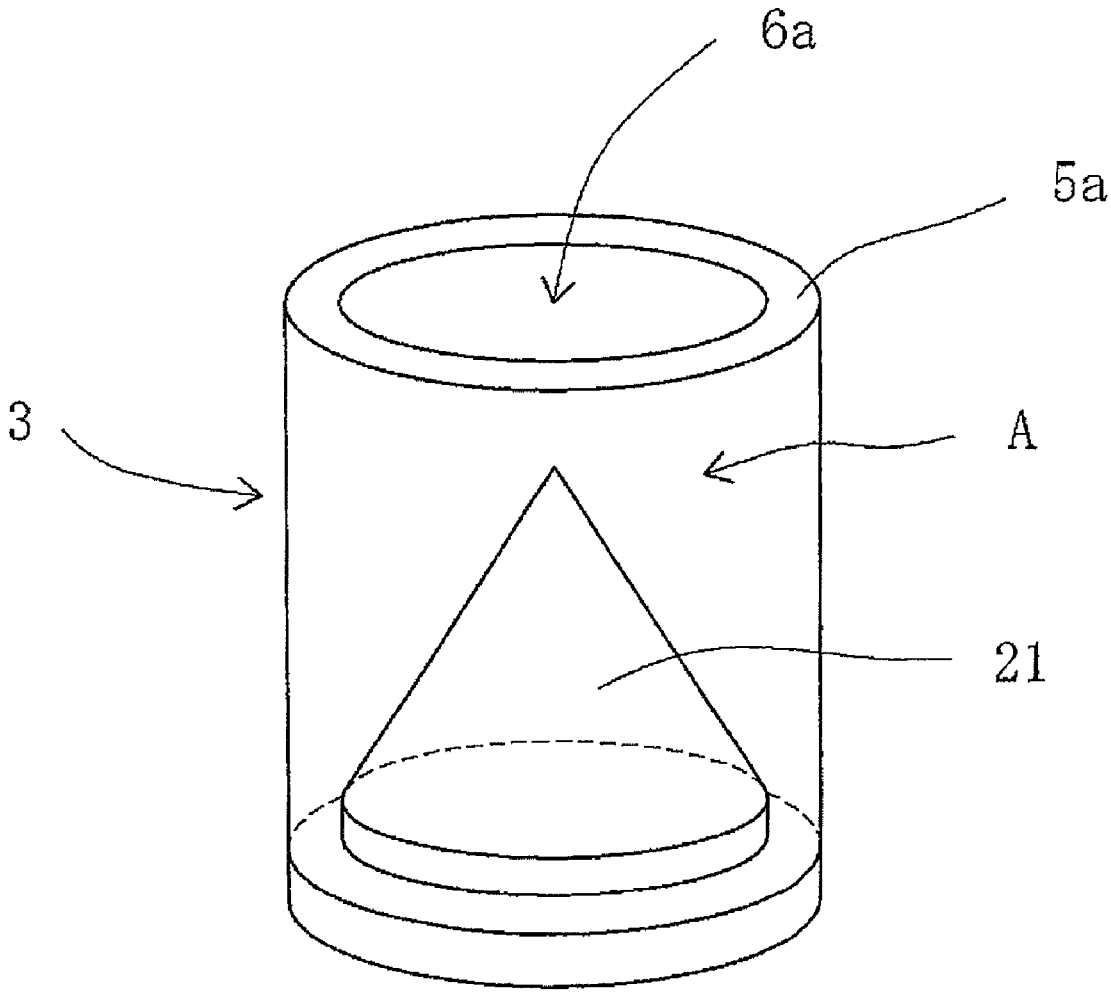
FIG. 9 is a view showing an another embodiment of the classification apparatus shown in FIG. 1.

According to the present invention, the rotor 2 of the magnetic stirrer is arranged in the classification tube 3 and is rotated, so that the powder substance is moved towards the outside and efficiently raised while being conveyed by the vortex flow, but as shown in FIG. 9, a cone shaped projection 21 may be arranged at the middle of the bottom of the classification tube 3 (the bottom of the first classification compartment A). This configuration has an effect similar to the rotor 2 of the magnetic stirrer.

Figure 4:
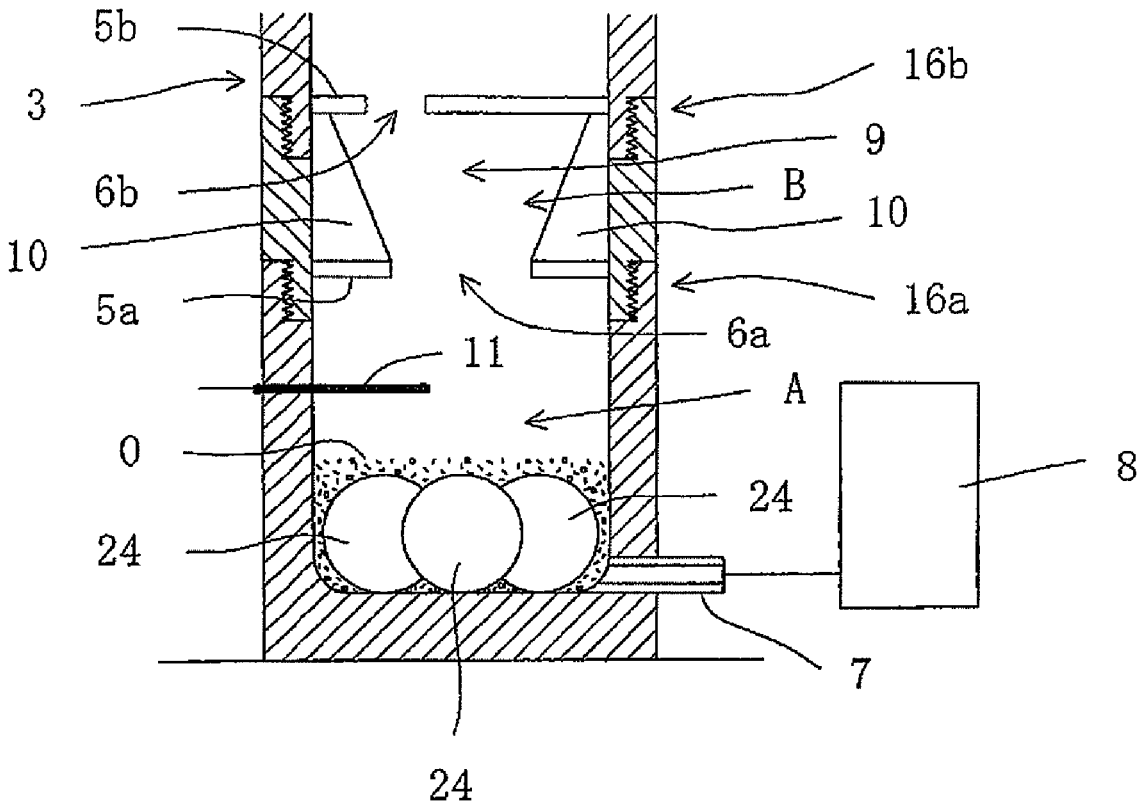
FIG. 4 is a view similar to FIG. 1 showing an another embodiment of the classification apparatus of FIG. 1.

FIG. 4 is a view similar to FIG. 1 showing an another embodiment of the classification apparatus shown in FIG. 1. The embodiment of FIG. 4 differs from the example of FIG. 1 only in the configuration of the conveyance acceleration means. Therefore, in FIG. 4, the portions having the same configuration as the embodiment of FIG. 1 are partially omitted, and same reference numerals are assigned to the same components as those shown in FIG. 1, and the detailed description thereof will be omitted.

Referring to FIG. 4, the conveyance acceleration means includes synthetic resin balls 24 arranged in the first classification compartment A in this embodiment. In this case, the inner diameter of the first classification compartment A is 2.6 to 4 times as large as the diameter of each of the balls 24, and four to eight of the same balls 24 are contained in the first classification compartment A.

The ball 24 may have a double-layer structure including a spherical core of a first synthetic resin, and an outer layer of a second synthetic resin overlaying the core. As described later, the balls 24 are rotated in an integrated manner by the gas flow emitted from the gas emission conduit 7. The ball 24 having a spherical metal core is preferable if the synthetic resin ball is too light, and the ball 24 having a cavity is preferable if too heavy.

Any synthetic resin may be used as long as it does not have toxicity on human body and excels in abrasion resistance property, but is preferably a polymer selected from a group consisting of one of polyacetal, Teflon (registered trademark), nylon, polyethylene, polypropylene, polycarbonate, polyphenylene sulfide, polymethyl pentene, polyethersulfone, and polyethylene telephtalate; synthetic resin may be a mixture of such polymers; or a copolymer containing the constituting monomer of such polymers.

According to such embodiment, the balls 24 are rotated in an integration manner in the first classification compartment A by the gas from the gas emission conduit 7, and the vortex flow V rises from the gap in the center of the aggregate of the balls 24. The powdery substance O in the classification compartment A is moved towards the center from the inner peripheral surface side of the classification compartment A, and raises while being conveyed by the vortex flow V. Similar to the embodiment of FIG. 1, the particles of the powdery substance O rise while being conveyed by the vortex flow V and are deposited in each classification compartment A to E according to the size, and furthermore, the particles of the powdery substance passed through the uppermost classification compartment E are captured by the filter 4. Thus, the particles of the powdery substance are classified in each classification compartment A to E according to the size in such a manner that the particle size becomes gradually smaller with increment of level of the classification compartment.

Figure 5:
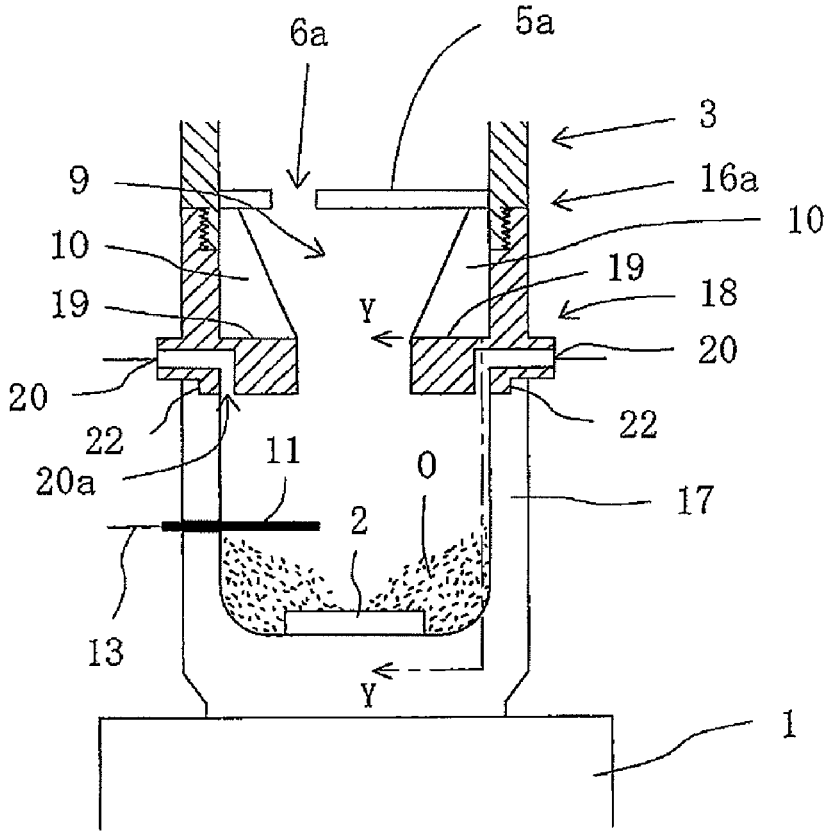
FIG. 5 is a view showing a schematic configuration of a classification apparatus for a powder substance according to another embodiment of the present invention, where (A) is a longitudinal cross sectional view showing the configuration of the main part, and (B) is a cross sectional view taken along line Y-Y of (A).
Figure 5:
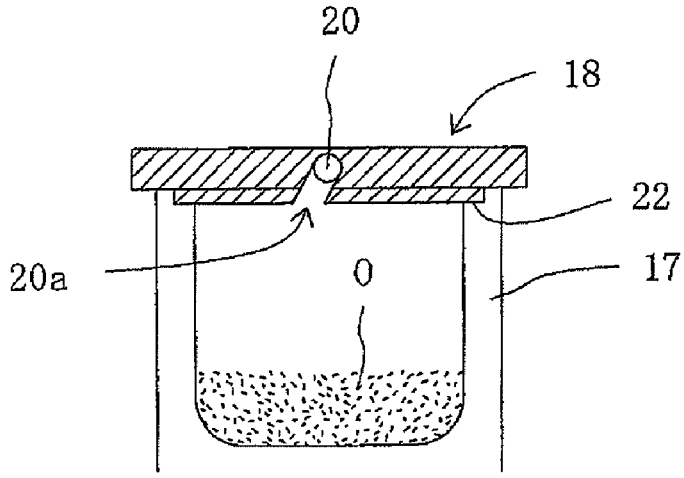

FIG. 5 is a view showing a schematic configuration of a classification apparatus for a powder substance according to another embodiment of the present invention, where (A) is a longitudinal cross sectional view showing the configuration of the main part, and (B) is a cross sectional view taken along line Y-Y of (A). The embodiment of FIG. 5 and the embodiment of FIG. 1 differ from each other in that, in the latter, the classification tube has the closed lower end opening, the classification tube itself also serves as a container for the powdery substance to be classified, and the rotor of the magnetic stirrer is also arranged in the classification tube, whereas in the former, a container and the classification tube are separated, the magnetic stirrer is arranged in the container, and the classification tube is connected to an upper end opening the container. Therefore, in FIG. 5, same reference numerals are assigned to the same components as the components shown in FIGS. 1 to 3 to avoid redundant explanation.

Referring to FIG. 5, according to the present embodiment, the magnetic stirrer composed of the main body 1 and the rotor 2; a container 17 with an upper end opening is arranged upright on the main body 1 of the magnetic stirrer and the powdery substance O to be classified is introduced in the container. Then the classification tube 3 is connected to the upper end opening of the container 17.

Although not shown, the filter is attached to the upper end opening of the classification tube 3, and the interior space of the classification tube is divided by the divider plates into a plurality of classification compartments lined up and down. Each of the divider plates is provided with an opening.

As shown in FIG. 5, the lower end of the classification tube 3 is provided with a connecting part 18. The inside of the upper portion of the peripheral wall of the container 17 is cutout into a cylindrical shape by half thickness, and a step 22 corresponding to the cutout of the upper portion of the peripheral wall of the container 17 is formed on the lower surface of the connecting part 18. The classification tube 3 is connected to the upper end opening of the container 17 by fitting the step 22 of the connecting part 18 into the cutout of the upper portion of the container 17.

The connecting part 18 has an inner flange 19. The inner flange 19 extends towards the inner side from the inner peripheral surface of the container 17. A plurality of gas emission conduits 20 extend from the outer side and opening to the container 17 through the connecting part 18. The gas emission conduits 20 are arranged at an interval in the peripheral direction of the connecting part 18.

As apparent from FIG. 5, each of the gas emission conduits 20 extends from the outside towards the center along the radial direction of the connecting part 18 to the inner peripheral surface of the container 17, then inclines by a constant angle downward and along the inner peripheral surface towards the bottom surface of the container 17, and opens to the container 17.

Similar to the example of FIG. 1, the columnar member 10 with the reversed circular cone shaped passage 9 is arranged in the space between the inner flange 19 of the classification tube 3 and the first divider plate 5*a*. The passage 9 communicates the container 17 with the first classification compartment. When the vortex flow is generated, the particles of the powdery substance O suddenly blown up by the vortex flow once return to the container 17 through the passage 9 without reaching the first classification compartment.

The rotor 2 of the magnetic stirrer is arranged in the container 17.

The peripheral wall of the container 17 is provided with a through-hole with a sealing plug in. The through-hole is arranged at a position that does not block the rotatable movement of the rotor 2 of the magnetic stirrer. The needle 11 is inserted in and fixed to the through-hole so as to project into the container 17. Similar to the embodiment of FIG. 1, the needle 11 is connected to the high voltage power source 12 through the cable 13, so that the particles conveyed by the vortex flow are charged positively or negatively in contact with the needle 11.

Since the needle 17 is removable with respect to the container 17, the container 7 can be used as a normal container by detaching the needle 17 from the container 7 and blocking the through-hole with the sealing plug when it is not used in classifying task.

Although not shown, the filter arranged at the upper end opening of the classification tube 3 is charged oppositely to the charge applied to the particles by the needle, similar to the embodiment of FIG. 1.

High pressure gas is supplied from the gas supply source arranged outside the classification tube 3 to the gas emission conduit 20, and the gas is emitted from the gas emission conduit 20, whereby a vortex flow rises from the inside of the container 17 sequentially toward the higher classification compartments of the classification tube 3, and at the same time, the rotor 2 of the magnetic stirrer is rotated, so that the powdery substance O in the container 17 is classified in each classification compartment according to the size in such a manner that the particle size becomes gradually smaller with increment of level of the classification compartment while being conveyed by the vortex flow.

According to this embodiment, the classification tube 3 and the container 17 are separately formed, and the classification tube 3 is connected to the container during classifying operation. Therefore, for example, it is possible that the powdery substance O manufactured in preprocess and contained in the container 7 is directly classified according to the size.

Figure 6:
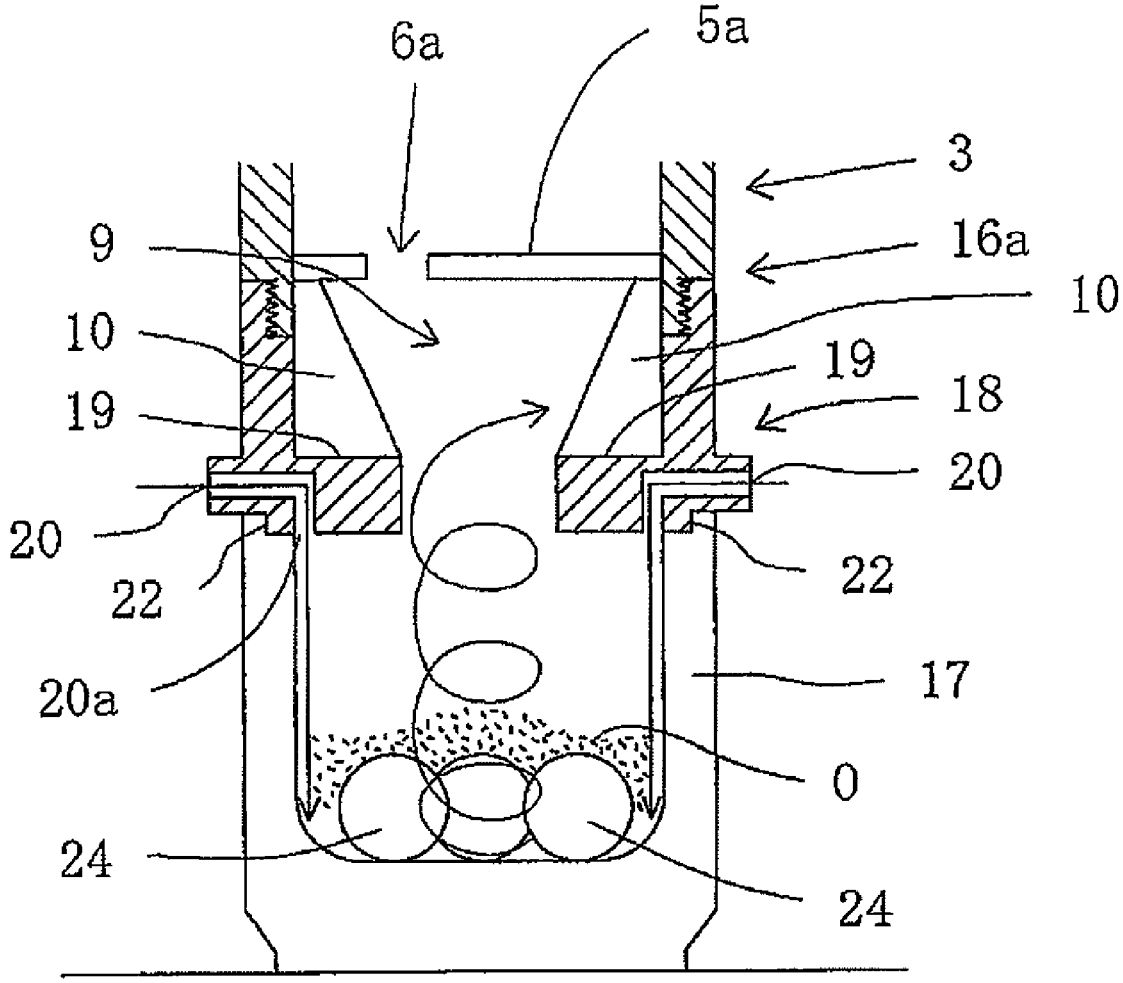
FIG. 6 is a view similar to FIG. 5 showing an another embodiment of the classification apparatus of FIG. 5.

FIG. 6 is a view similar to FIG. 5(A) showing an another embodiment of the classification apparatus of FIG. 5. The another embodiment of FIG. 6 differs from the embodiment of FIG. 5 only in the configuration of the conveyance acceleration means. Therefore, in FIG. 5, the portions having the same configuration as the embodiment of FIG. 6 are partially omitted, and same reference numerals are assigned to the same components as the components shown in FIG. 6, and the detailed description thereof will be omitted.

Referring to FIG. 6, the conveyance acceleration means includes synthetic resin balls 24 arranged in the container in this embodiment, similar to the embodiment of FIG. 4. The inner diameter of the container 17 is 2.6 to 4 times as large as the diameter of the ball 24, and four to eight of the same balls 24 are contained in the container 17, similar to the embodiment of FIG. 4. The material, the internal structure and so on of the ball 24 are also the same as the embodiment of FIG. 4.

In this embodiment, for example, in the process of manufacturing powdered food such as powdered tea and powdered Chinese herbal medicine using a ball mill device, a pot detached from the ball mill device can be used as the container after the pulverizing process by the ball mill device is completed. Thus, washing of the inside of the pot and takeoff of the powdery substance from the pot can be simultaneously and easily performed, and moreover, the classification according to the size can be performed simultaneously with the takeoff of the powdery substance, whereby the productivity significantly is enhanced.

Figure 7:
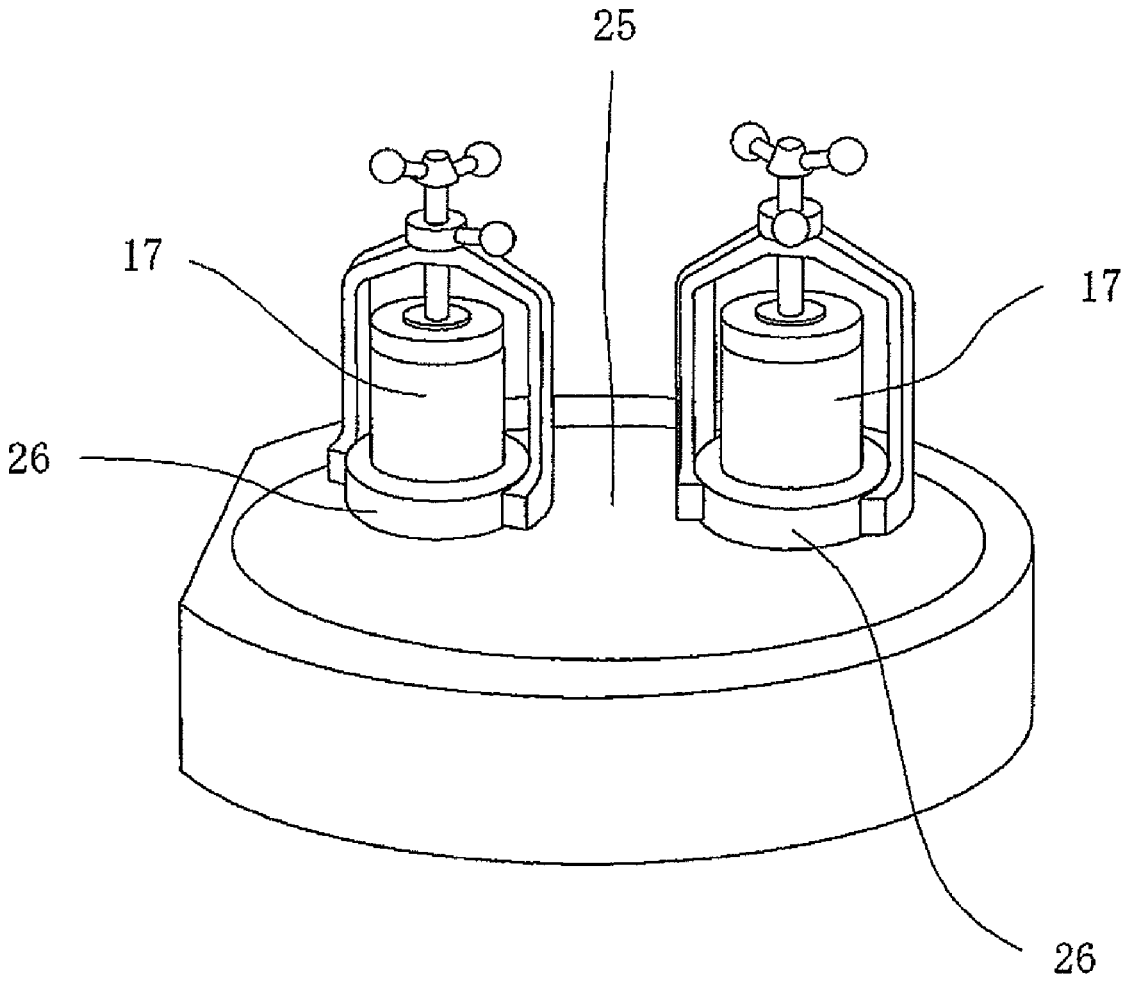
FIG. 7 is a perspective view of a ball mill device attached with a container used in the embodiment shown in FIG. 6.

FIG. 7 is a perspective view showing a schematic configuration of a ball mill device. Referring to FIG. 7, the ball mill device includes a rotatable table 25, and a pot rotation base 26 arranged on the rotatable table 25. The rotatable table 25 is rotatably driven around the center axis thereof and the pot rotation base 26 is rotatably driven around the center axis thereof relative to the rotatable table 25. A pot 17 enclosed with balls and product ingredient (ingredient of powdered tea etc.) is fixed on the pot rotation base 26, and rotated around the center axis of the rotatable table 25 by the drive of the rotatable table 25, and rotated around its own axis by the drive of the pot rotation base 26.

The pot 17 and the ball 24 are made from synthetic resin. The pot 17 and the ball 24 made from the same type of synthetic resin do not always need to be combined for use, and the pot 17 and the ball 24 made from different types of synthetic resin may be combined for use.

The specific gravity of the ball 24 is appropriately changed according to the dimension of the ball 24 and the pot 17, as well as the type of product ingredient. The specific gravity of the ball 24 is changed by preparing a ball which has a double-layer structure consisting of a spherical core of a first synthetic resin and an outer layer of a second synthetic resin overlaying the core with the use of two types of synthetic resin having different specific gravities from each other, or incorporating a spherical metal core to the ball 24 or forming a cavity inside the ball 24.

Figure 8:
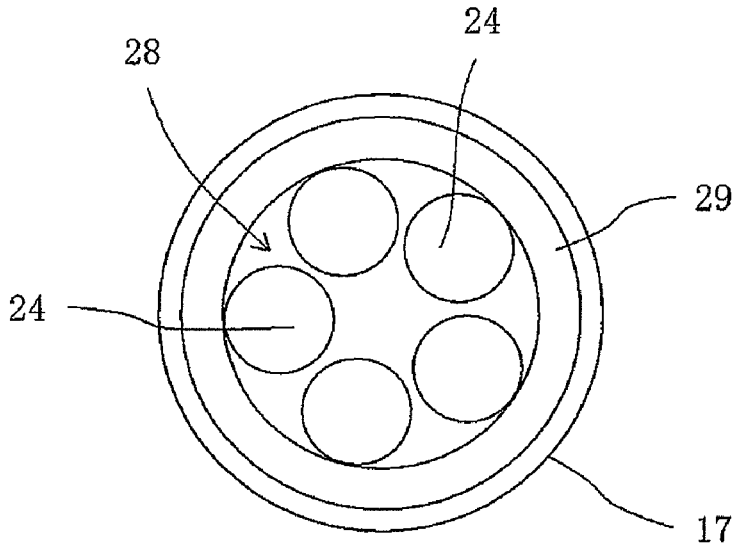
FIG. 8 is a view showing the configuration of the container attached to the ball mill device of FIG. 7, where (A) is a plan view of the container without a lid and (B) is a longitudinal cross sectional view of the container with a lid.
Figure 8:
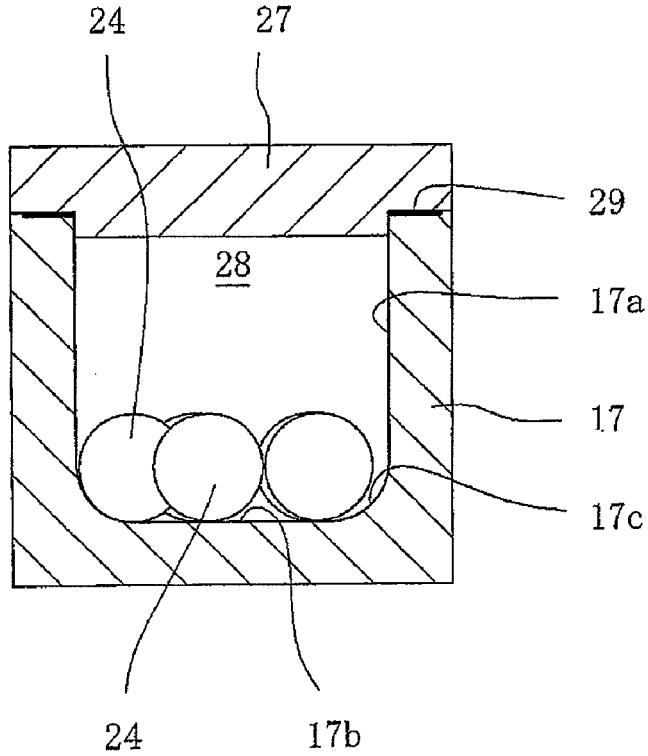

FIG. 8 is a view showing a configuration of the pot 17 attached to the ball mill device, where (A) is a plan view of the pot without a lid, and (B) is a longitudinal cross sectional view of the pot with a lid. Referring to FIG. 8, the curvature radius of a transition portion 17*c* from a peripheral wall surface 17*a* to a bottom wall surface 17*b* of an hollow portion 28 of the pot 17 is equal to or greater than the curvature radius of the ball 24. Furthermore, the diameter of the hollow portion 28 of the pot 17 is 2.6 to 4 times as large as the diameter of the ball 24, and four to eight of the same balls 24 may be contained in the pot 17.

The pot 17 is contained with the product ingredient and the balls 24, with a lid 27 through a packing 29, and attached to the pot rotation base 26. When pulverization of the product ingredient by the ball mill device is completed, the pot 17 is detached from the pot rotation base 26, and the lid 27 is detached from the pot 17. The pot 17 is used as the container of the present invention, and the classification tube 3 of the present invention is connected to the upper end opening with the powdery substance and the ball 24 contained therein.

According to this embodiment, the balls 24 are rotated in an integrated manner in the container 17 by the gas from the gas emission conduit 20, and the vortex flow rises from the gap in the center of the aggregate of the balls 24. The powdery substance O in the container 17 is moved towards the center from the inner peripheral surface side of the container 17, and raises certainly while being conveyed by the vortex flow. Similar to the embodiment of FIG. 5, the particles of the powdery substance O are raised while being conveyed by the vortex flow, and collected in each classification compartment so that the powdery substance O is classified according to the size in such a manner that the particle size becomes gradually smaller with increment of level of the classification compartment.

Figure 10:
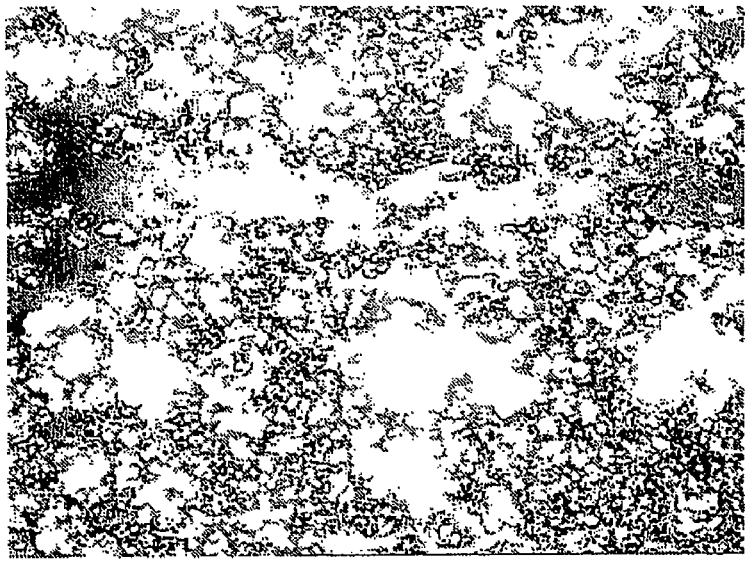
FIG. 10 is an optical microscope picture of twig tea classified using the classification apparatus of the present invention, where (A) is twig tea classified in the uppermost classification compartment, and (B) is twig tea classified in the lowermost classification compartment.
Figure 10:
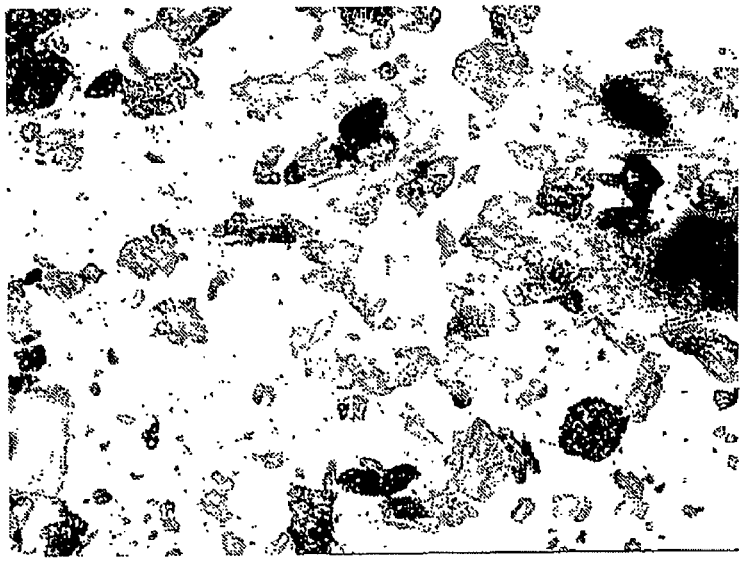

In order to check the effect of the present invention, the classification of twig tea is performed using the classification apparatus (not equipped with needle, and filter not charged) similar to the embodiment of FIG. 1. The five classification compartments of the classification apparatus all have diameter 110 mm×height 50 mm. After completing the classifying process, the twig tea classified in the lowermost classification compartment and the twig tea classified in the uppermost classification compartment were collected, respectively and the particle size of each of two groups of the collected twig tea was examined using an optical microscope. FIG. 10(A) is an optical microscope picture of the twig tea classified in the uppermost classification compartment, and (B) is an optical microscope picture of the twig tea classified in the lowermost classification compartment. As seen from FIG. 10, the particles having a particle diameter of around 10 μm occupy the majority of the particles classified in the uppermost classification compartment, and the particles having a particle diameter of around 50 μm occupy the majority of the particles classified in the lowermost classification compartment.

The invention claimed is:

1. A classification apparatus for a powdery substance comprising a classification tube provided with an upper end opening, a closed lower end, a filter attached to the upper end opening, and at least two classification compartments divided by divider plates and lined up and down in the interior space thereof, each of the divider plates having at least one opening, the first classification compartment having a supply port for a powdery substance to be classified, a gas emission conduit extending from the outside into the first compartment through a peripheral wall, a distal end opening of the gas emission conduit being directed in a tangential direction of an inner peripheral surface at the vicinity of a bottom surface of the classification compartment, high pressure gas being supplied to the gas emission conduit from a gas supply source arranged outside the classification tube, a vortex flow being generated in the classification tube by the gas from the gas emission conduit and rising from the first classification compartment sequentially towards the higher classification compartments; and conveyance acceleration means for accelerating conveyance of the powdery substance by the vortex flow so as to prevent the powdery substance from remaining in the first classification compartment while the vortex flow is being generated, whereby the powdery substance of the first classification compartment is classified in every classification compartment according to the size while being conveyed by the vortex flow.

2. The classification apparatus for the powdery substance according to claim 1, wherein the conveyance acceleration means includes a magnetic stirrer composed of a main body and a rotor, and the classification tube is arranged upright on the main body of the magnetic stirrer, and the rotor of the magnetic stirrer is arranged in the first classification compartment, and the rotor of the magnetic stirrer is rotated simultaneously with the generation of the vortex flow.

3. The classification apparatus for the powdery substance according to claim 1, wherein the conveyance acceleration means includes four to eight synthetic resin balls arranged in the first classification compartment, and the inner diameter of the first classification compartment is 2.6 to 4 times as large as the diameter of each of the balls, whereby the balls are rotated in an integrated manner in the first classification compartment by the gas from the gas emission conduit and the vortex flow rises from a gap in the center of the aggregate of the balls.

4. The classification apparatus for the powdery substance according to claim 1, wherein a height between the bottom surface of the classification tube and the first divider plate is set to be a level at which, when the vortex flow is generated, particles of the powdery substance suddenly blown up by the vortex flow once return to the first classification compartment without reaching a second classification compartment.

5. The classification apparatus for the powdery substance according to claim 1, wherein the classification tube includes at least three classification compartment, and a reverse circular cone shaped passage is arranged in the second classification compartment for communicating the first classification compartment with the third classification compartment, and a lower end of the passage is connected to a circular opening formed at the middle of the first divider plate, and an upper end is connected to a circular region including an opening of the second divider plate, and when the vortex flow is generated, particles of the powdery substance suddenly blown up by the vortex flow once return to the first classification compartment through the passage without reaching the third classification compartment.

6. The classification apparatus for the powdery substance according to claim 1, wherein a needle for applying positive or negative charge to the particles conveyed by the vortex flow protrudes in the first classification compartment, and the needle is connected to a high voltage power source arranged outside the classification tube through a cable.

7. The classification apparatus for the powdery substance according to claim 6, wherein the filter is charged oppositely to the charge applied to the particles by the needle.

8. A classification apparatus for a powdery substance comprising a container with an upper end opening, a powdery substance to be classified being introduced in the container;

a classification tube connected to the upper end opening of the container, the classification tube comprising a filter attached to an upper end opening thereof, a plurality of classification compartments divided by divider plates and lined up and down in the interior space thereof, each of the divider plates having at least one opening, a lower end of the classification tube being provided with a connecting part, the connecting part having an inner flange and a means for connecting to the container, the inner flange extending inward over an inner peripheral surface of the container, the connecting part having a plurality of gas emission conduits extending from the outside into the container, the gas emission conduits being arranged at intervals in a peripheral direction of the connecting part, distal end openings of the gas emission conduits being inclined at a constant angle downward and along the peripheral wall towards a bottom surface of the container, high pressure gas being supplied to the gas emission conduits from a gas supply source arranged outside the classification tube, a vortex flow being generated by the gas from the gas emission conduits and rising from the interior of the container sequentially towards the higher classification compartments in the classification tube; and conveyance acceleration means for accelerating conveyance of the powdery substance by the vortex flow so as to prevent the powdery substance from remaining in the container while the vortex flow is being generated, whereby the powdery substance of the container is classified in every classification compartment according to the size while being conveyed by the vortex flow.

9. The classification apparatus for the powdery substance according to claim 8, wherein the conveyance acceleration means includes a magnetic stirrer composed of a main body and a rotor, and the container is arranged upright on the main body of the magnetic stirrer, and the rotor of the magnetic stirrer is arranged in the container, and the rotor of the magnetic stirrer is rotated simultaneously with the generation of the vortex flow.

10. The classification apparatus for the powdery substance according to claim 8, wherein the conveyance acceleration means includes four to eight synthetic resin balls arranged in the container, and the inner diameter of the container is 2.6 to 4 times as large as the diameter of each of the balls, and the balls is rotated in an integrated manner in the container by the gas from the gas emission conduit, and the vortex flow rises from a gap in the center of the aggregate of the balls.

11. The classification apparatus for the powdery substance according to claim 8, wherein a reverse circular cone shaped passage is arranged in a space between an inner flange of the classification tube and the first divider plate for communicating the container with the first classification compartment, and a lower end of the passage is connected to a circular opening of the inner side of the inner flange, and an upper end is connected to a circular region including an opening of the first divider plate, and when the vortex flow is generated, particles of the powdery substance suddenly blown up by the vortex flow once return to the container through the passage without reaching the first classification compartment.

12. The classification apparatus for the powdery substance according to claim 8, wherein the peripheral wall of the container is provided with a through-hole with a sealing plug, and a needle is inserted in and fixed to the through-hole, the needle extending from the outside of the container into the container, and the needle is connected to a high voltage power source through a cable, and the particles conveyed by the vortex flow are charged negatively or positively in contact with the needle.

13. The classification apparatus for the powdery substance according to claim 12, wherein the filter is charged oppositely to the charge applied to the particles.

14. The classification apparatus for the powdery substance according to uny onc of claim 1 or 8, wherein the classification tube is separable for every classification compartment.

15. The classification apparatus for the powdery substance according to claim 2 or 9, wherein the rotor of the magnetic stirrer is in the form of a rod having a rounded triangular cross section.

16. The classification apparatus for the powdery substance according to claim 3 or 10, wherein the ball has a double-layer structure consisting of a spherical core of a first synthetic resin, and an outer layer of a second synthetic resin overlaying the core.

17. The classification apparatus for the powdery substance according to claim 3 or 10, wherein each of the balls includes a spherical metal core or a cavity.

18. The classification apparatus for the powdery substance according to claim 3 or 10, wherein the synthetic resin is a polymer selected from a group consisting of one of polyacetal, Teflon (registered trademark), nylon, polyethylene, polypropylene, polycarbonate, polyphenylene sulfide, polymethyl pentene, polyethersulfone, and polyethylene telephtalate; mixture of the polymers; or a copolymer containing a constituting monomer of the polymers.

* * * * *

UNITED STATES PATENT AND TRADEMARK OFFICE

CERTIFICATE OF CORRECTION

PATENT NO. : 7,735,658 B2
APPLICATION NO. : 12/161906
DATED : June 15, 2010
INVENTOR(S) : Hidaka et al.

It is certified that error appears in the above-identified patent and that said Letters Patent is hereby corrected as shown below:

Column 15, line 16 (Claim 14, line 2) the phrase "uny onc of" should be deleted.

Signed and Sealed this

Fifth Day of October, 2010

David J. Kappos

David J. Kappos
*Director of the United States Patent and Trademark Office*